US007389627B2

(12) United States Patent
Miles

(10) Patent No.: US 7,389,627 B2
(45) Date of Patent: Jun. 24, 2008

(54) METHOD OF SHIPPING CONTAINER WITH EXPANDING BAG

(76) Inventor: David Miles, 11418 Knott St., Garden Grove, CA (US) 92841

( * ) Notice: Subject to any disclaimer, the term of this patent is extended or adjusted under 35 U.S.C. 154(b) by 217 days.

(21) Appl. No.: 11/266,467

(22) Filed: Nov. 3, 2005

(65) Prior Publication Data

US 2007/0095712 A1 May 3, 2007

(51) Int. Cl.
*B65B 31/00* (2006.01)
*B65B 63/02* (2006.01)
*B65D 81/20* (2006.01)

(52) U.S. Cl. ..... 53/434; 53/436; 206/524.8

(58) Field of Classification Search ..... 206/522–523, 206/524.8, 495.5; 53/430–438, 449; 410/119–130
See application file for complete search history.

(56) References Cited

U.S. PATENT DOCUMENTS 2,364,012 A * 11/1944 Walton et al. ..... 206/524.8
2,863,305 A * 12/1958 Shepherd ..... 206/459.5
3,344,973 A * 10/1967 Studen ..... 206/523
4,620,633 A * 11/1986 Lookholder ..... 206/524.8
4,640,080 A * 2/1987 Wright ..... 206/524.8
5,096,078 A * 3/1992 McQueeny ..... 206/522
5,129,519 A * 7/1992 David et al. ..... 206/524.8
5,351,830 A * 10/1994 Bender et al. ..... 206/524.8
5,402,906 A * 4/1995 Brown et al. ..... 206/524.8
5,628,404 A * 5/1997 Hendrix ..... 206/524.8
6,202,849 B1 * 3/2001 Graham ..... 206/524.8
6,305,545 B1 * 10/2001 Morrow ..... 206/522
6,537,003 B1 * 3/2003 Rostoker ..... 410/119
6,675,971 B2 * 1/2004 Case ..... 206/524.8
6,769,848 B2 * 8/2004 Rostoker ..... 410/119
2005/0284775 A1 * 12/2005 McLaughlin et al. ..... 53/436

* cited by examiner

*Primary Examiner*—Bryon P Gehman
(74) *Attorney, Agent, or Firm*—Russo & Duckworth, LLP

(57) ABSTRACT

A shipping container is provided for transporting biologically hazardous materials. The shipping container includes a rigid gas permeable exterior enclosure and an interior positioned substantially gas impermeable flexible bag. Preferably, the exterior enclosure includes an outer cardboard box and inner foam box made of expanded polystyrene. Preferably, the inner bag is made of polyethylene and includes a conventional open top. Preferably, the bag also includes two laterally extending lines. A first line provides a visual indication to the user where air should be evacuated from the bag. A second line is provided to indicate where the bag should be sealed.

5 Claims, 3 Drawing Sheets

METHOD OF SHIPPING CONTAINER WITH EXPANDING BAG

BACKGROUND OF THE INVENTION

The present invention relates to shipping containers. More specifically, the present invention relates to improved shipping containers for safely, conveniently, and inexpensively shipping hazardous materials within the non-pressurized cargo hold of an aircraft.

Shipping containers are used to transport small sizes or quantities of hazardous materials such as medical diagnostic specimens, biological materials, and infectious substances by private or public carriers. These samples are routinely collected and then shipped for medical implantation, diagnosis and other tasks. For example, blood samples are commonly taken at the office or home and then packaged and mailed to a laboratory for testing. With the onslaught of diseases which may be transmitted via bodily fluid contact, and the ever increasing number of biological specimens being transported via the mail and courier services, the integrity and safety of shipping devices used to transport these specimens has become of greater and greater importance. Thus, the shipping of biological specimens poses a significant health risk if the specimen is not placed within a suitably safe container. To this end, there are numerous federal regulations in the United States including those in Titles 29, 39, 42 and 49 of the United States Code of Federal Regulations. In addition, additional agencies have imposed safe packaging and shipping standards. These agencies include the International Civil Aviation Organization, United States Department of Transportation, United States Center for Disease Control, and United States Occupational Safety and Health Administration, among others.

In trying to transport hazardous items in compliance with the foregoing regulations and standards, problems have arisen concerning the shipping container's durability, rigidity, size, weight and cost. These issues are especially significant because the containers must be leak proof and pressure resistant. Durability problems exist with rigid containers due to the inevitable bangs, scrapes and dents that can occur to containers during handling and transport. These potential problems can bring about a loss of integrity. Another problem that exists is that containers can be very large in comparison to the material or specimens being transported, thereby creating unnecessary cost of the container and increased cost for transportation.

As a result of the foregoing problems, various attempts have been made to develop shipping containers which can withstand the rigors of transportation and withstand the atmospheric changes that result from non-pressurized aircraft flight. For example, U.S. Pat. No. 5,129,519 describes a package for aircraft travel. The container includes a semi-rigid outer casing, foam insulation and a flexible plastic liner for encasing articles to be shipped. Unfortunately, the container includes an unconventional foldable package which locks in place around articles to be shipped. The package is relatively expensive to manufacture and it is dubious whether it provides an airtight seal.

Meanwhile, U.S. Pat. No. 6,161,695 describes a structure including a cardboard box, foam package and sealable, flexible package. Unfortunately, the package requires a vacuum source to seal the package, thereby adding cost to shipping. U.S. Pat. No. 5,996,799 discloses a shipping container including an inner flexible bag and an outer flexible bag. The structural integrity of both bags is required to enable the container to meet national and international testing criteria for transportation. Moreover, the structure utilizes flexible sidewalls which does not protect the contents of the package from damage during shipping.

Thus, there is a significant need for a shipping container which is inexpensive to manufacture and meets applicable federal regulations and standards for the air transport of biological specimens.

SUMMARY OF THE INVENTION

Briefly, in accordance with the invention, I provide an improved shipping container. The shipping container provides an inexpensive to manufacture and use structure for transporting biological specimens which meets the requirements of various federal regulations and standards including Department of Transportation regulations expressed in 49 C.F.R. §§173.196; 173.27; 178.609 and 178.503. Among other requirements, these regulations require that packaging be capable of withstanding "an internal pressure which produces a gauge pressure of not less than 75 kPa (psig) for liquids in Packaging Group III of Class 3 or Division 6.1 or 95 kPa (14 psig) for other liquids."

To this end, the shipping container includes an exterior enclosure. The exterior enclosure may be constructed of various materials as can be selected by one skilled in the art. However, it is intended that the exterior enclosure be substantially rigid and gas permeable. In a preferred embodiment, the exterior enclosure is constructed in two parts and includes an outer box constructed of corrugated cardboard, and an inner box constructed of expanded polystyrene foam insulation, such as sold under the trademark Styrofoam®.

In addition to the exterior enclosure, the shipping container of the present invention includes an interior flexible bag. During shipment, the bag is sealed to be substantially gas impermeable. Moreover, of importance in practicing the present invention, the bag is sized so that, if filled with air or other contents, it will engage all of the walls of the exterior enclosure if placed within its interior cavity. The bag may be constructed of various materials as can be determined by one skilled in the art. However, preferably the bag is a construction commonly referred to as a poly bag made of polyethylene plastic.

To use the shipping container of the present invention, biologically hazardous materials are placed within the interior of the bag. The bag is then at least partially evacuated of air. Evacuation of the bag may be accomplished using a vacuum source. However, it is preferred that a vacuum source is not utilized, and instead air is simply manually discharged from the bag by squeezing excess air from the bag. Once evacuated, the bag is sealed to provide a substantially gas impermeable barrier. Sealing of the bag may be accomplished by numerous means known to those skilled in the art. For example, the bag may be a Ziploc® type bag. The bag may be heat sealed using an electrical heat sealing device. Alternatively, the bag may be simply twist sealed and bound with a band, such as a tie strap or rubber band.

The sealed flexible bag is then placed within the interior cavity of the exterior enclosure. Where the exterior enclosure has the preferred construction of a cardboard outer box and Styrofoam® inner box, the flexible bag is positioned within the interior of the Styrofoam® box, which is positioned within the cardboard box. Preferably, the cardboard box is closed using a high strength packing tape, and each of the corners of the box are further reinforced with one or more strips of packing tape.

The shipping container is originally packaged at a first atmospheric pressure. However, during air transportation, the shipping container will undergo a second atmospheric pressure, such as where an aircraft transports the shipping container within a non-pressurized cargo hold. For example, the shipping container packaged at sea level will withstand a pressure reduction of approximately 14 psi where it is traveling at 81,000 feet above sea level. Since the exterior enclosure is substantially gas permeable, the interior flexible bag expands due to the residual air within the bag expanding until the bag expands so as to fill the interior cavity of the exterior enclosure. Further expansion of the bag is restricted by the rigid construction of the exterior enclosure, so as to prevent the bag from bursting.

It is thus an object of the present invention to provide a simple inexpensive construction for shipping containers.

It is another object of the present invention to provide a shipping container which meets or exceeds federal regulations and standards concerning the transportation of biologically hazardous materials. These and other more specific objects and advantages of the present invention will be apparent to those skilled in the art from the following detailed description taken in conjunction with the drawings.

DETAILED DESCRIPTION OF THE INVENTION

Figure 1:
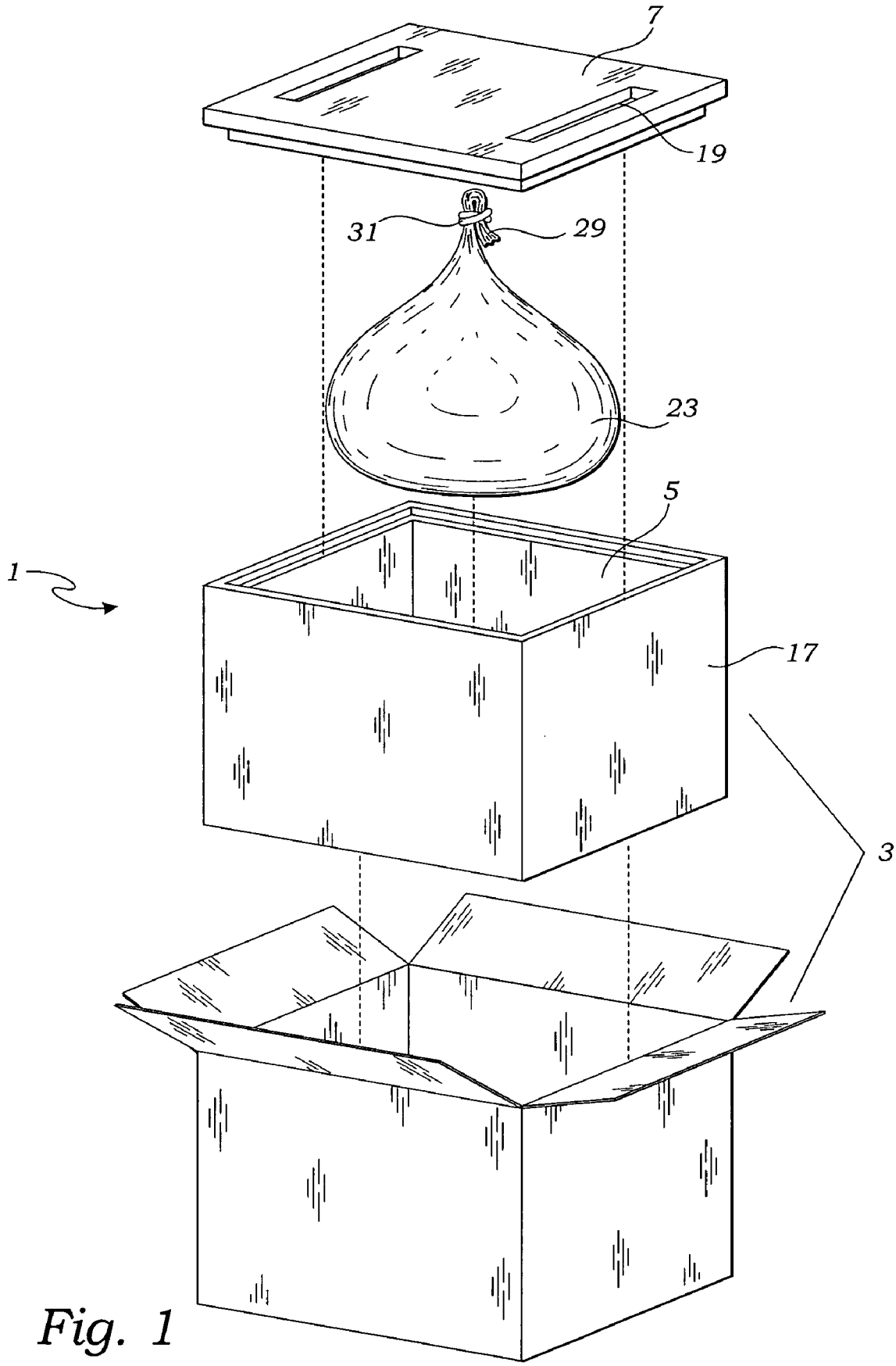
FIG. 1 is an exploded perspective view illustrating the shipping container of the present invention.
Figure 2:
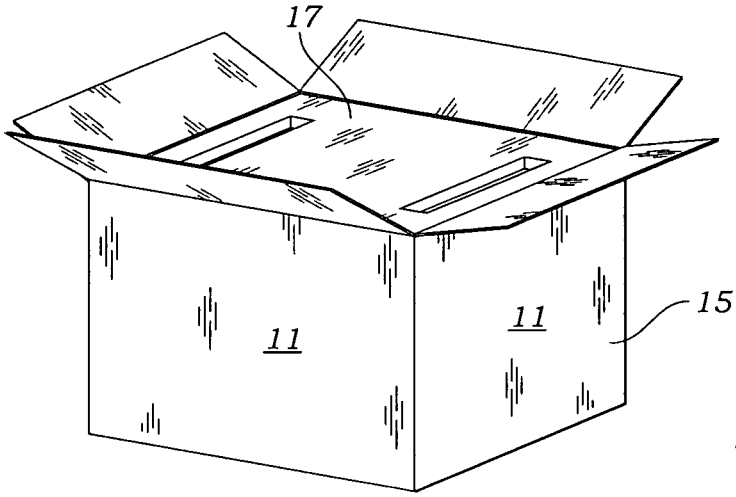
FIG. 2 is a perspective view of the shipping container of the present invention reflecting an open top.
Figure 3:
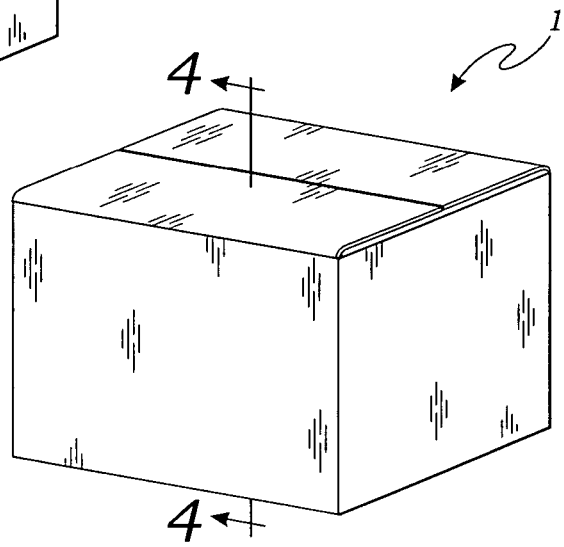
FIG. 3 is a perspective view of the shipping container of the present invention having a closed top.

While the present invention is susceptible to the embodiment in various forms, as shown in the drawings, hereinafter will be described the presently preferred embodiments of the invention with the understanding that the present disclosure is to be considered as a exemplification of the invention and is not intended to limit the invention to the specific embodiments illustrated.

With reference to the figures, the shipping container 1 of the present invention includes an exterior enclosure 3 and a bag 23 located within the exterior enclosure. The exterior enclosure may be constructed in any shape including cylindrical or cubic. However, as shown in the figures, preferably the shipping container 1 is constructed with a traditional box shape typically used for shipping. The exterior enclosure may also be constructed in various sizes and of various materials. For example, the exterior enclosure may be constructed of plastic, and even metal. However, for shipping most smaller items, it is preferred, and as shown in the figures, that the exterior enclosure be constructed in two parts including an outer box made of approximately 3 mm thick corrugated cardboard 15, and an interior box made of expanded polystyrene 17 having a wall thickness of several centimeters. The exterior enclosure is assembled by inserting the foam box 17 within the interior of the cardboard box to form the exterior enclosure 3 having a top 7, a bottom 9, and sidewalls 11 to form a central cavity 5.

The bag 23 of the present invention may also be constructed of various materials. However, the bag must be flexible and substantially gas impermeable, in other words airtight. Accordingly, plastic or rubber are considered preferred materials, and poly bags made of polyethylene plastic and having gusseted reinforced corners is considered the preferred bag. Of importance, the bag 23 must have a size sufficiently large that when sealed and completely filled, the volume of the bag is greater than the volume of the exterior enclosure's interior cavity 5.

Figure 4:
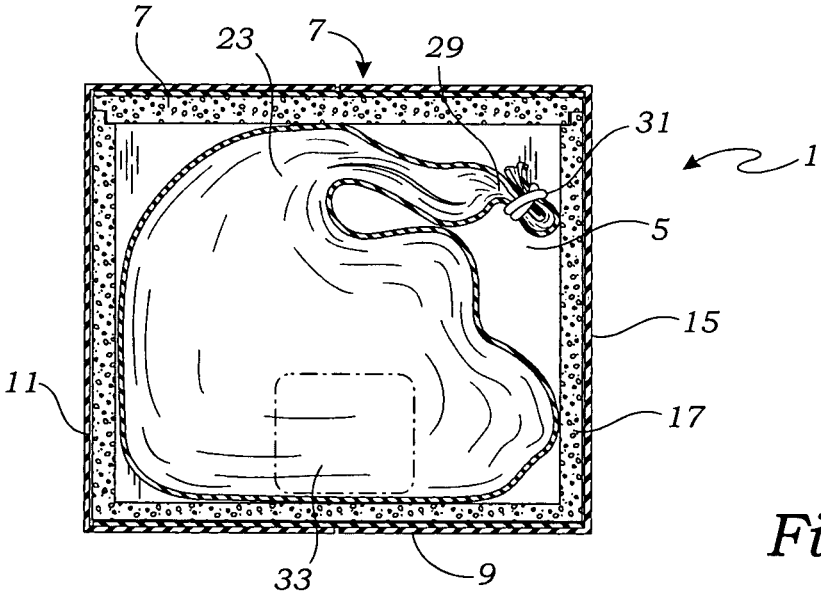
FIG. 4 is a cross-sectional side view illustrating the shipping container of the present invention at a first atmospheric pressure.
Figure 5:
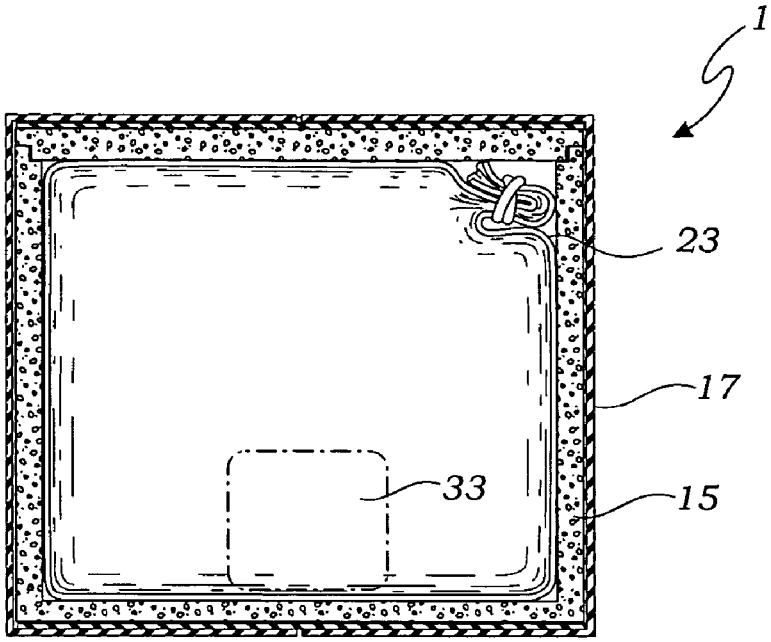
FIG. 5 is a cross-sectional side view of the shipping container of the present invention at a second atmospheric pressure.
Figure 6:
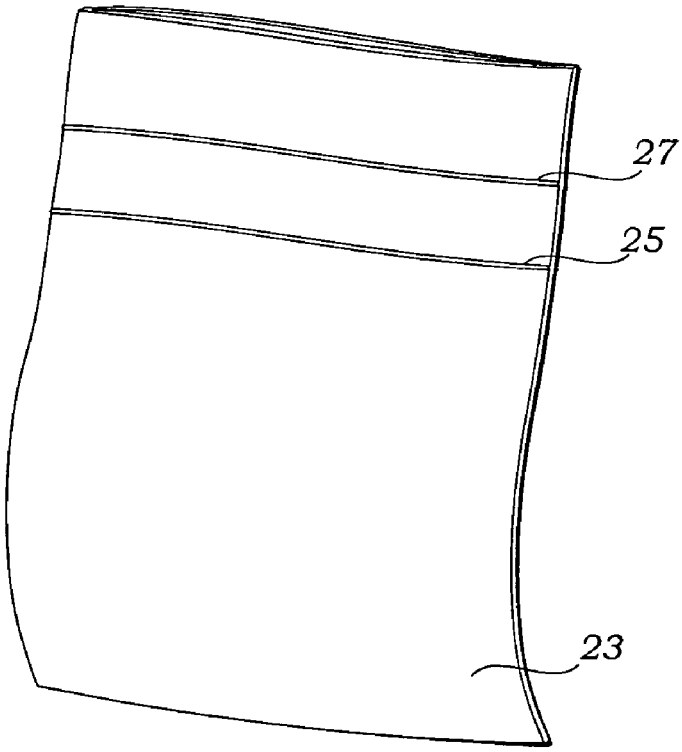
FIG. 6 is a perspective view illustrating a preferred flexible bag for use with the shipping container of the present invention.

The bag may be sealed by various techniques as can be determined by those skilled in the art. With reference to FIGS. 4-6, in a preferred embodiment the bag is sealed by twisting the open end of the bag, folding the twisted portion 29 back upon itself, and then banding the end with a rubber band, tie strap 31 or similar tying mechanism. As shown in FIG. 6, a preferred bag 23 of the present invention includes two laterally extending lines 25 and 27. Preferably, the lines are of different colors, and in a preferred embodiment the first line 25 is colored red and the second line 27 is colored blue. Prior to sealing the bag, excess air is removed from the bag to the extent that it can be accomplished manually by squeezing the bag. The first red line 25 provides a visual indication to the user of the shipping container as to where the user should ensure that air is evacuated above the line prior to sealing. The bag is then twisted above the red line 25 and then folded back upon itself. A zip tie is then bound around the bag at the blue line 27.

In still an additional embodiment, the bag includes instructions printed on the exterior of the bag to provide the user directions as to how to seal the bag. Preferred instructions are recited as follows.

Instructions

1. This bag must be used with box number Bxx and EPS insert number Ixx.
2. Make sure that the desiccant material is inside the bag.
3. Note: Do Not under any circumstances place Dry Ice inside this bag. Dry Ice should be placed underneath the bag or to the side.
4. In general, excess air is to be removed from bag to the extent possible.
5. Care should be taken to ensure that air is evacuated above the red line.
6. Tightly wrap and secure the first enclosed zip tie around the bag at the blue line.
7. Ensure that the end of the bag above the blue line is tightly twisted. Bend the portion of the bag that you have just twisted 90°. Holding the end in place wrap the second zip tie around the end of the bag securing it at the Blue Line.

The shipping container 1 including exterior enclosure 3 and bag 23 may be constructed of any size. However, preferred shipping container constructions include a small size and medium size dimensioned as follows. A preferred small size shipping container includes an outer cardboard box which is 11"×9"×10". An inner foam box 17 is positioned snugly within the outer cardboard box. In a preferred embodiment, the inner foam box has sidewalls which are approximately 1¼" thick to form an interior cavity of approximately 8½"×6½"×7½". A preferred bag for use with the small shipping container is 25" long and 10" wide. Meanwhile, a preferred medium sized shipping container includes an outer cardboard box 15 that is 15"×13"×12". Again, the shipping container includes an inner foam box 17 having sidewalls approximately 1¼" thick to form an interior cavity that is 12½"×10½"×9½". A preferred bag for use with the medium sized shipping container is 36" long ×24" wide.

The shipping container of the present invention provides for an inexpensive and simple to manufacture enclosure for shipping biologically hazardous materials. Moreover, the shipping container has been found to meet or exceed Department of Transportation regulations expressed in 49 C.F.R. §§173.196; 173.27; 178.609 and 178.503. While several particular forms of the invention have been illustrated and described, it will be apparent that various modifications can be made without departing from the spirit and scope of the invention. Accordingly, it is not intended that the invention be limited except by the following claims.

I claim:

1. A method of shipping items within a shipping container:

providing a shipping container including an exterior substantially rigid substantially gas permeable enclosure sized so as to be manually hand-carried having a plurality of walls including a top, a bottom and one or more sidewalls, and a substantially flexible substantially gas impermeable bag to be located within said exterior enclosure, said bag being partially evacuated of air and sized so as to not fill the interior cavity of said exterior enclosure at a first atmospheric pressure, said bag sized so as to fill the interior cavity of said exterior enclosure and to engage all of said walls at a second atmospheric pressure;

positioning an item to be shipped within said bag;

at least partially evacuating air from said bag prior to sealing said bag;

sealing said bag;

placing said sealed bag within said exterior enclosure; and transporting said shipping container from a first atmospheric pressure to a second atmospheric pressure wherein said bag expands to engage all of the walls of said exterior enclosure so that said bag is restrained from bursting as a result of said bag engaging said walls.

2. A method of shipping items within a shipping container of claim 1 wherein said bag includes a first marking and said step of evacuating air from said bag includes evacuating air to said first marking.

3. A method of shipping items within a shipping container of claim 2 wherein said bag includes a second marking and said step of sealing said bag includes sealing said bag at said second marking.

4. A method of shipping items within a shipping container of claim 1 wherein second atmospheric pressure is approximately 14 pounds per square inch less than said first atmospheric pressure.

5. A method of shipping items within a shipping container of claim 1 wherein said exterior enclosure includes an outer box constructed of cardboard and an inner box constructed of polystyrene foam insulation.

* * * * *